US008132687B2

(12) United States Patent
Fedusa et al.

(10) Patent No.: US 8,132,687 B2
(45) Date of Patent: Mar. 13, 2012

(54) DOUBLE-WALLED CONTAINER AND METHOD OF MANUFACTURE

(75) Inventors: Anthony J. Fedusa, Lower Burrell, PA (US); Robert E. Dick, Cheswick, PA (US); Darl G. Boysel, Delmont, PA (US)

(73) Assignee: Alcoa Inc., Pittsburgh, PA (US)

( * ) Notice: Subject to any disclaimer, the term of this patent is extended or adjusted under 35 U.S.C. 154(b) by 100 days.

(21) Appl. No.: 12/492,963

(22) Filed: Jun. 26, 2009

(65) Prior Publication Data

US 2009/0321440 A1 Dec. 31, 2009

Related U.S. Application Data

(60) Provisional application No. 61/075,977, filed on Jun. 26, 2008.

(51) Int. Cl.
*B65D 8/06* (2006.01)
*B65D 8/12* (2006.01)
*B65D 8/20* (2006.01)

(52) U.S. Cl. ..... 220/62.18; 220/592.16; 220/592.17; 220/906

(58) Field of Classification Search ..... 220/62.18, 220/506, 592.16, 592.17, 739, 906
See application file for complete search history.

(56) References Cited

U.S. PATENT DOCUMENTS

| | | | | |
|---|---|---|---|---|
| 2,186,338 | A * | 1/1940 | Mills | 220/288 |
| 2,863,585 | A * | 12/1958 | Philip | 220/592.17 |
| 3,065,875 | A * | 11/1962 | Kaiji | 220/784 |
| 3,456,860 | A * | 7/1969 | Janninck | 229/400 |
| 4,333,581 | A * | 6/1982 | Flansburg | 220/501 |
| 4,548,348 | A * | 10/1985 | Clements | 220/738 |
| 5,335,813 | A | 8/1994 | Qi | |
| 5,497,900 | A * | 3/1996 | Caleffi et al. | 220/656 |
| 6,719,514 | B1 * | 4/2004 | Mensink | 413/4 |
| 2005/0061818 | A1 | 3/2005 | Ichikawa et al. | |

FOREIGN PATENT DOCUMENTS

| | | |
|---|---|---|
| CA | 2109562 | 6/1994 |
| EP | 0337500 | 10/1989 |
| EP | 1319494 | 6/2003 |
| EP | 1714912 | 10/2006 |
| JP | 03254322 | 11/1991 |
| JP | 2001123431 | 8/2001 |
| JP | 2005096794 | 4/2005 |
| WO | 2008/002741 | 1/2008 |

OTHER PUBLICATIONS

International Search Report dated Nov. 20, 2009 from corresponding International application PCT/US2009/048941.

* cited by examiner

*Primary Examiner* — Harry Grosso
(74) *Attorney, Agent, or Firm* — Greenberg Traurig LLP

(57) ABSTRACT

A double-walled container and method of manufacturing are disclosed. A first container having a smaller diameter than a second container is inserted into the second container. A portion of the first container is expanded and/or a portion of the second container may be narrowed so that first and second container is interlocked and form a double-walled container. The first and/or second containers may have ribs. An air gap between the first and second containers provides thermal insulation to contents of the double-walled container.

15 Claims, 21 Drawing Sheets

DOUBLE-WALLED CONTAINER AND METHOD OF MANUFACTURE

CROSS-REFERENCE TO RELATED APPLICATION

This application claims priority to U.S. Provisional Patent Application No. 61/075,977, entitled "Method of Manufacturing Containers," filed on Jun. 26, 2008, which is incorporated herein by reference in its entirety.

BACKGROUND

Beverage, food and aerosol containers are commonly comprised of metal. Metal containers may take several forms such as a drinking cup, can, bottle, or aerosol. Metal containers may be manufactured by several methods including: drawing, drawing and ironing, draw reverse draw, drawing and stretching, deep drawing, 3-piece seaming, and impact extrusion. Metal containers may be finished in many different ways including curling, flanging, threading, seaming, etc.

SUMMARY

A method of manufacturing a double-walled container comprises providing a first container having a diameter X; providing a second container having a diameter Y, wherein the diameter Y is larger than the diameter X; inserting the first container into the second container; and interlocking the first container and the second container. In some embodiments, interlocking the first container and the second container comprises expanding the diameter X of a portion of the first container and narrowing the diameter Y of a portion of the second container. In some embodiments, the diameter Y of a portion of the second container expands as the diameter X of a portion of the first container is expanded. In some embodiments, interlocking the first container and the second container comprises expanding the diameter X of a portion of the first container and curling a top edge of the first container. In some embodiments, a top edge of the second container is curled as the top edge of the first container is curled. In some embodiments, interlocking the first container and the second container comprises expanding the diameter X of a portion of the first container and double-seaming a top edge of the first container. In some embodiments, a top edge of the second container is double-seamed as the top edge of the first container is double-seamed. In some embodiments, interlocking the first container and the second container comprises narrowing the diameters of a portion of the first container and a portion of the second container. In some embodiments, a gap lies between a portion of the first container and a portion of the second container. In some embodiments, an opening of the double-walled container is narrowed to accept a closure. In some embodiments, the first container and/or the second container have ribs.

A double-walled container comprises an inner container; and an outer container wherein the inner container and the outer container are interlocked. In some embodiments, a diameter of a top portion of the outer container has been narrowed. In some embodiments, a diameter of a portion of the inner container has been narrowed. In some embodiments, a diameter of a portion of the inner container has been expanded. In some embodiments, a diameter of a portion of the outer container has been expanded. In some embodiments, the first and/or second containers have ribs. In some embodiments, a gap lies between a portion of the first container and a portion of the second container. In some embodiments, a top edge of the first container is curled. In some embodiments, a top edge of the first container is formed to accept a closure.

DESCRIPTION

In the following detailed description of the preferred embodiments, reference is made to the accompanying drawings which form a part hereof, and in which are shown by way of illustration specific embodiments in which the invention may be practiced. It is to be understood that other embodiments may be utilized and structural changes may be made without departing from the scope of the present invention.

In one embodiment of the invention, a method of manufacturing a double-walled container comprises providing a first container having a diameter X; providing a second container having a diameter Y, wherein the diameter Y is larger than the diameter X; inserting the first container into the second container; and interlocking the first container and the second container so that the first and second containers form a single double-walled container. Interlocking the first container and the second container means securing the first container at least partially inside of the second container to prevent axial movement of the first container relative to the second container. When the containers are interlocked, they still may rotate relative to one another. The first container does not need to be completely encompassed by the second container as will be shown in certain examples herein.

In some embodiments, interlocking the first container and the second container may comprise expanding the diameter X of a portion of the first container and narrowing a portion of the second container along with an expanded portion of the first container. In some embodiments, the portion of the second and/or first container that is narrowed is a smaller portion than the portion that had been expanded. In some embodiments interlocking the first container and the second container may comprise expanding the diameter X of a portion of the first container and curling or seaming the top edges of both containers or of the first container. Any other appropriate methods of finishing the edges or forming the opening of the double-walled container to accept a closure may be used.

In some embodiments, interlocking the first container and the second container comprises narrowing the diameter Y of a portion of the second container and curling or seaming the top edges of both containers or of the first container. In some embodiments, interlocking the first container and the second container comprises narrowing the diameter Y of a portion of the second container and narrowing the diameter X of a portion of the first container.

Figure 1:
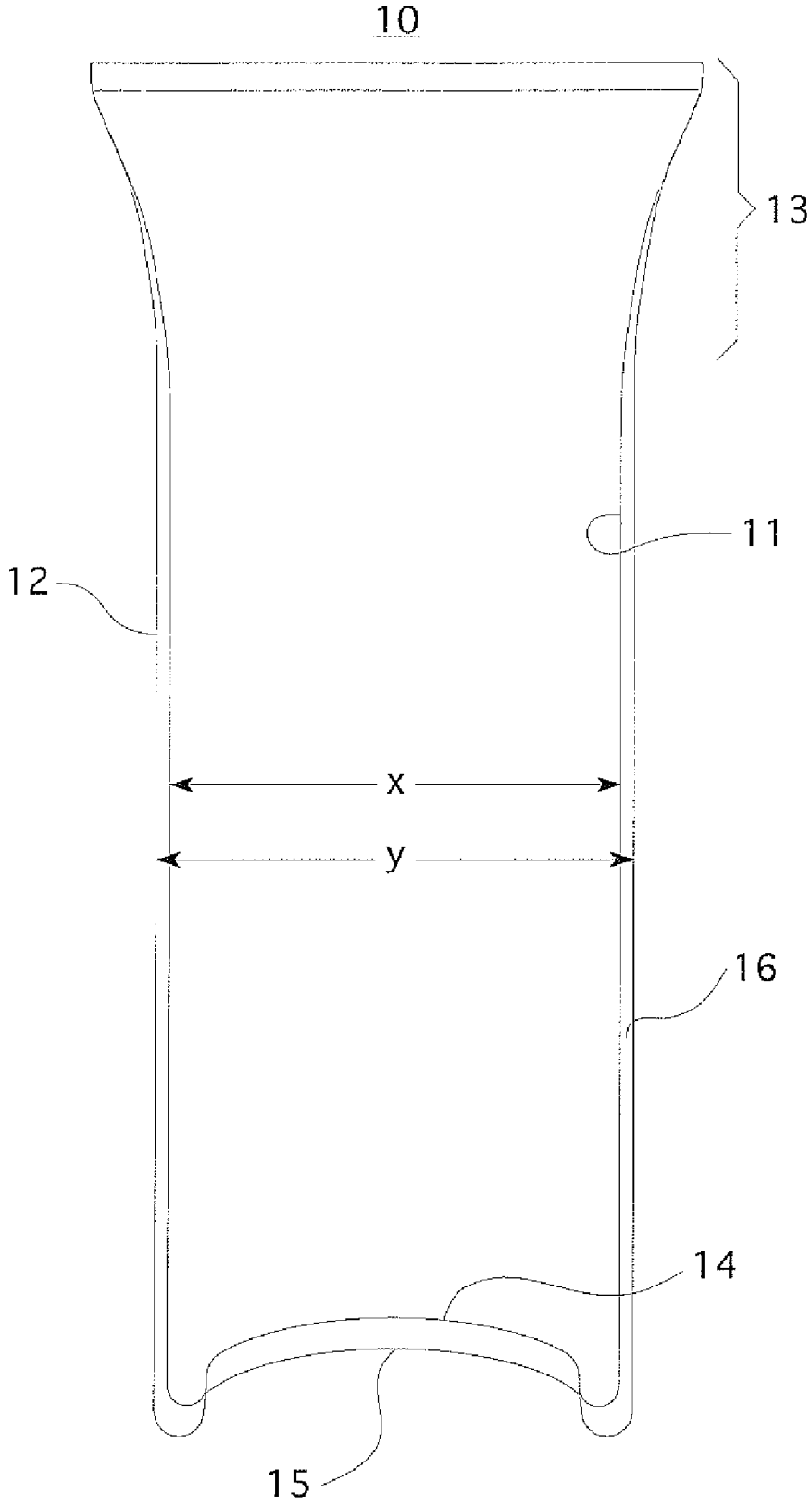
FIG. 1 shows a cross-section of a double-walled container according to one embodiment of the invention.
Figure 2:
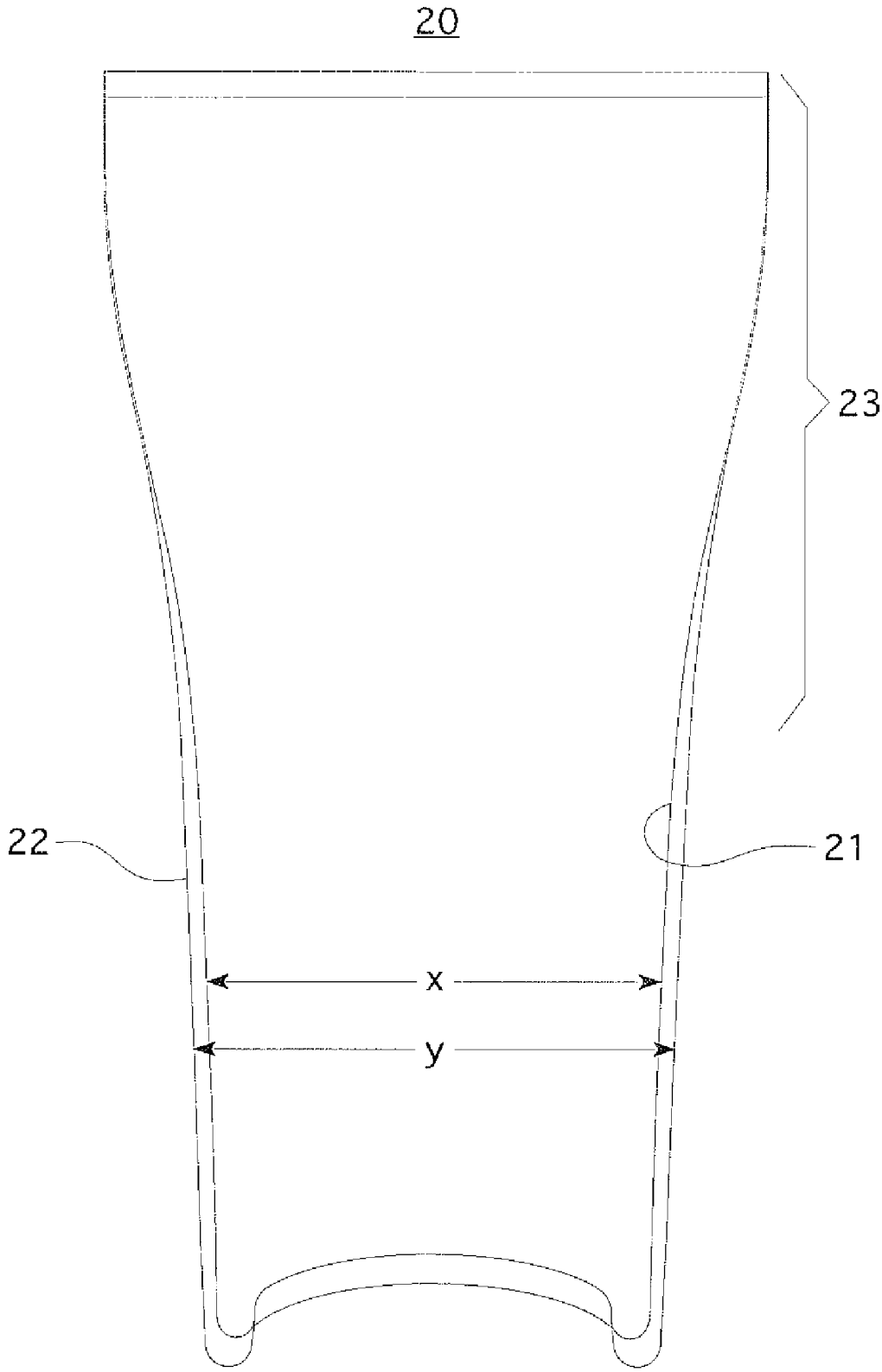
FIG. 2 shows a cross-section of a double-walled container according to another embodiment of the invention.
Figure 3:
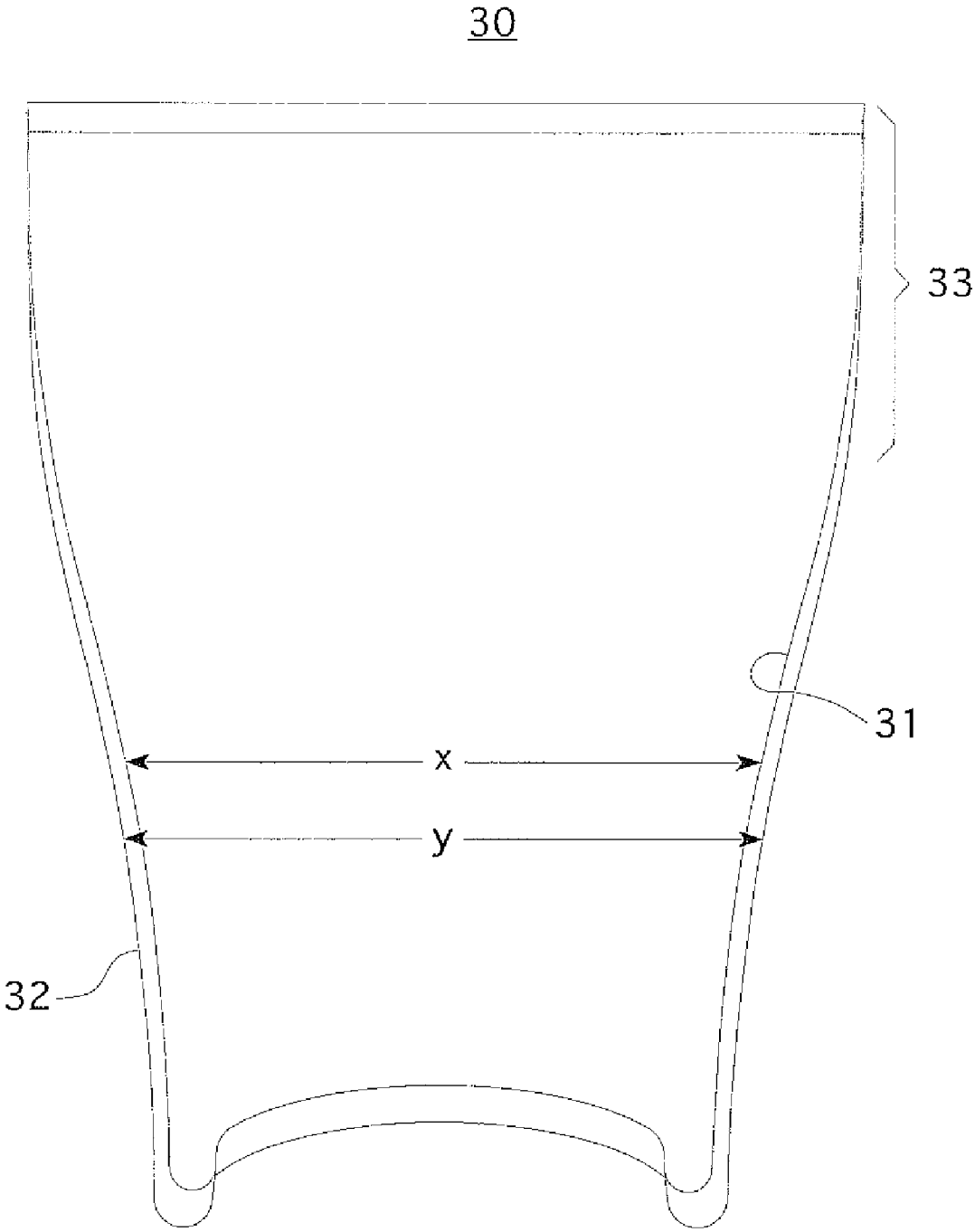
FIG. 3 shows a cross-section of a double-walled container according to yet another embodiment of the invention.

Three examples of double-walled containers formed in accordance with embodiments of the invention are shown in FIGS. 1-3. FIGS. 1-3 each show a double-walled container 10, 20, and 30, respectively, wherein the top portions 13, 23, and 33, respectively, of both the first container 11, 21, and 31, respectively, and the second container 12, 22, and 32 respectively, have been expanded. The top edges of containers 11, 12, 21, 22, 31 and 32 are curled. First container 11 is interlocked with second container 12. First container 21 is interlocked with second container 22. And, first container 31 is interlocked with second container 32.

Figure 4:
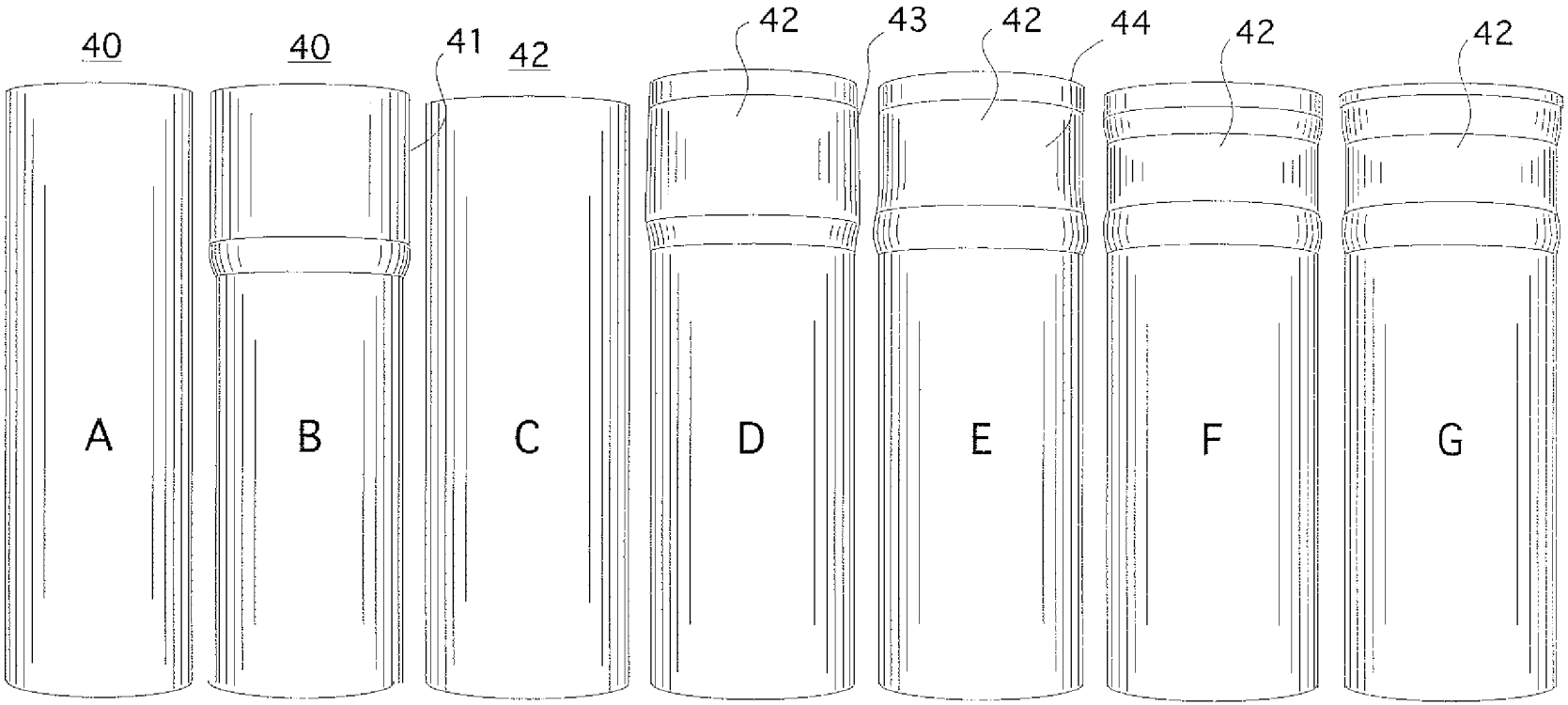
FIG. 4 shows a series of containers after undergoing process steps in a series of process steps according to an embodiment of the invention.
Figure 5:
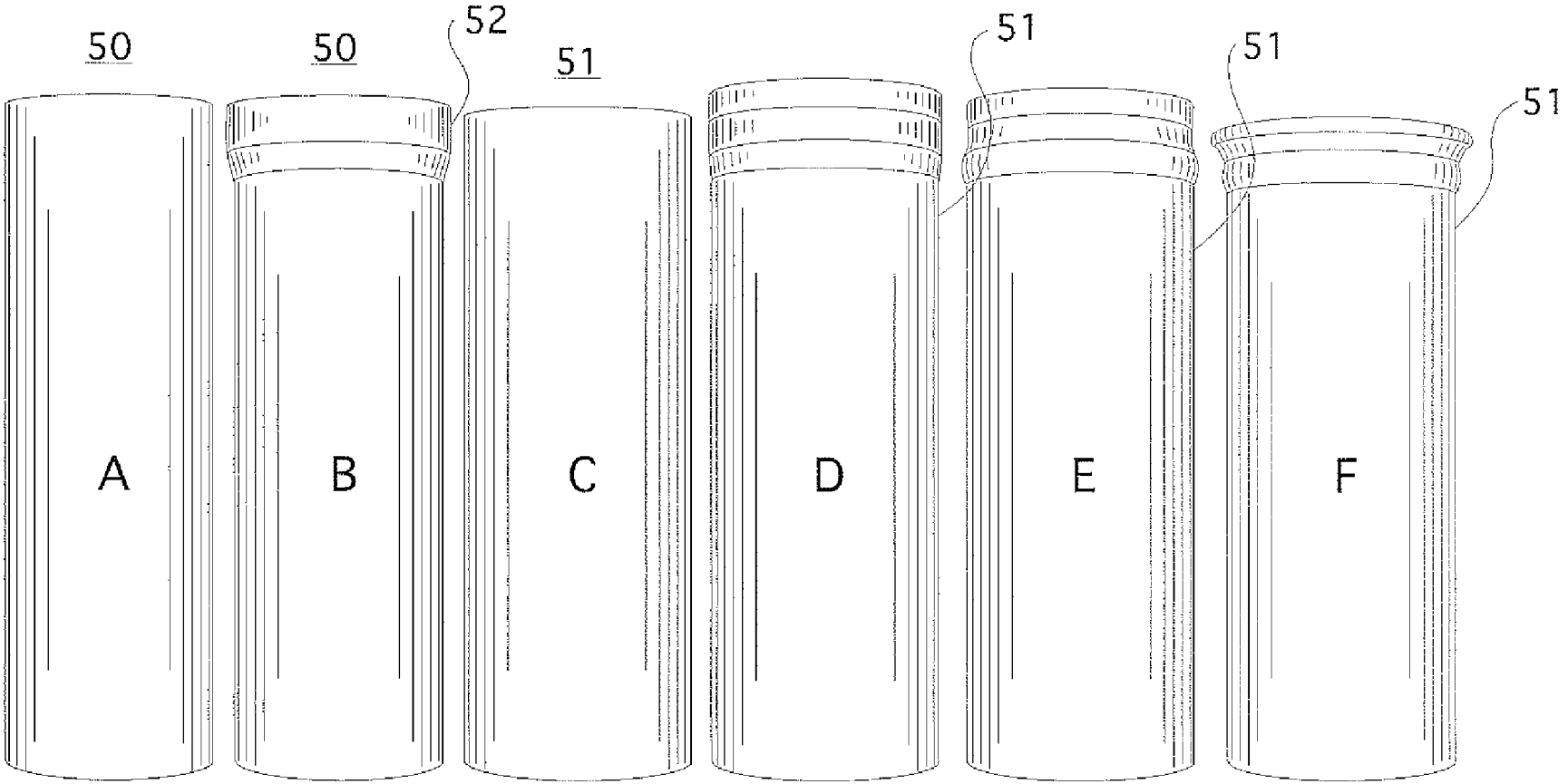
FIG. 5 shows a series of containers after undergoing process steps in a series of process steps according to another embodiment of the invention.

FIGS. 4 and 5 show containers after certain example manufacturing steps according to some embodiments of the invention. Referring to FIG. 4, the first container 40 in step A started with a 53 mm diameter. In step B, a top portion 41 of the first container 40 had been expanded to a 57.4 mm diameter. The expansion was accomplished by using a the expansion die shown in FIG. 7. In step C, a second container 42, having a 59 mm diameter was provided. In step D, the first container 40 was placed inside the second container 42. A small clearance between the two containers prevented air from being trapped and compressed. Then, both containers were expanded together using a larger diameter expansion die shown in FIG. 8, by inserting the die into the partially expanded first container. The expansion die shown in FIG. 8 expanded the top portion of the partially expanded can an additional 0.059" (1.5 mm) per side to a diameter of 60.4 mm. The die travel was adjusted to produce the desired length of expanded surface. In step E, a top portion 44 of both containers was narrowed, via die necking without a knockout, to a diameter of 59 mm. In Step F, another top portion of both containers was expanded. In step G, top edges of both containers were double seamed.

Referring now to FIG. 5, in step A, a first container 50, having a 53 mm diameter, was provided. In step B, a top portion 52 of the first container 50 was expanded. In step C, a second container 51 having a 59 mm diameter was provided. In step D, the first container 50 was placed inside the second container 51 and top portions of the first container 50 and the second container 51 were expanded together. In step E, top portions of the first container 50 and the second container 51 were narrowed, via die necking without a knockout, to a diameter of 59 mm. In step F, top edges of both containers 50 and 51 were curled outward.

In other embodiments, a lower or middle portion of the first and/or second containers may be expanded and/or narrowed.

Figure 16:
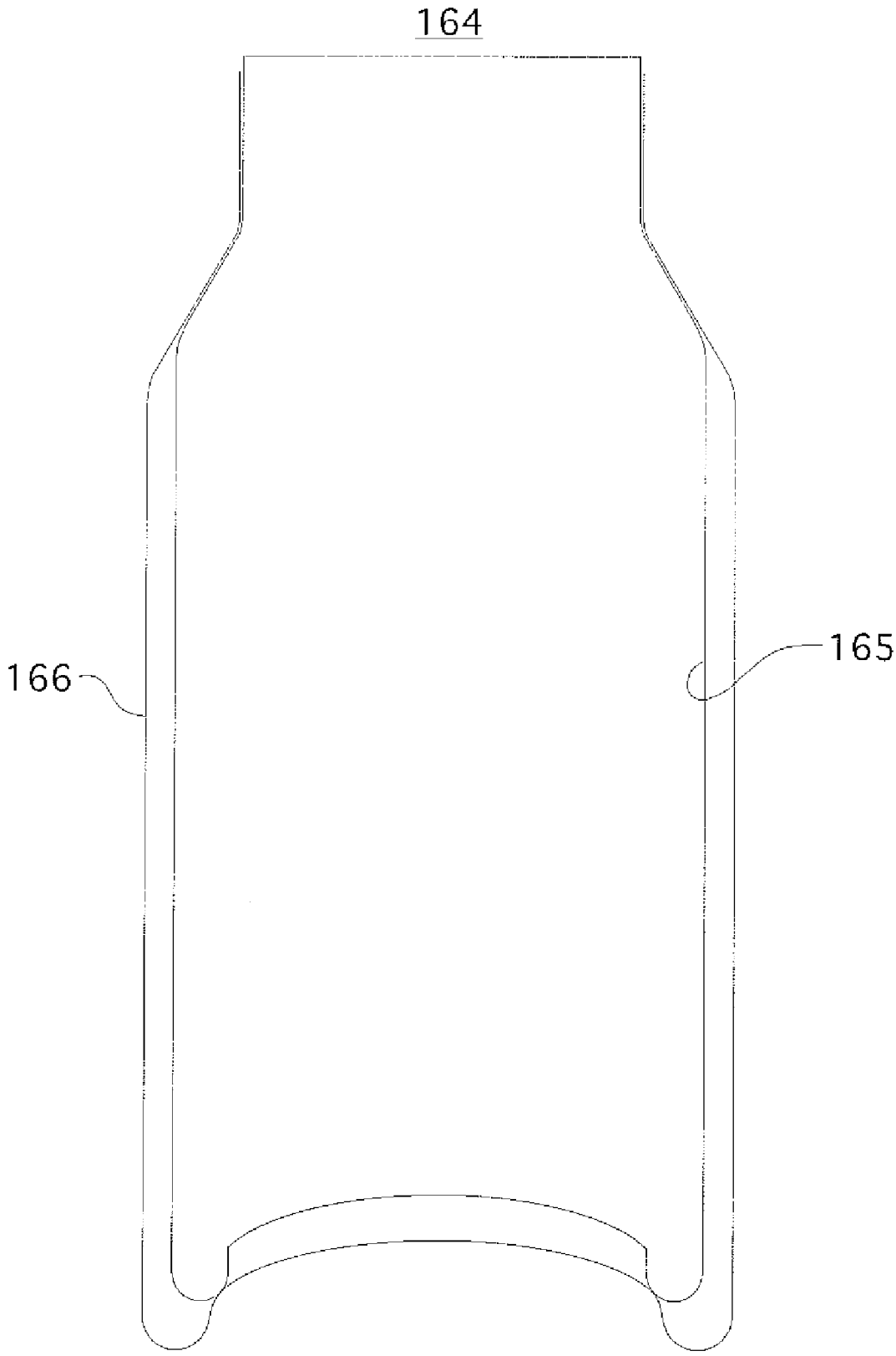
FIG. 16 shows a partial cross-section view of yet a further embodiment of the invention.

In another embodiment of the invention, a method of manufacturing a double-walled container comprises providing a first container having a diameter X; providing a second container having a diameter Y, wherein the diameter Y is larger than the diameter X; inserting the first container into the second container; and narrowing a top portion of the second container. In some embodiments in which the second container is narrowed a knockout is used in the narrowing process. In some embodiments, the second container may be necked, using a knockout, to a diameter just slightly larger than the first container, the first container is then placed inside the second container and then a knockout is placed inside the first container and both the first and second containers are necked together. FIG. 16 shows double-walled container 164 wherein the first container 165 and the second container 166 have been interlocked by narrowing both the first container and the second container.

Figure 6C:
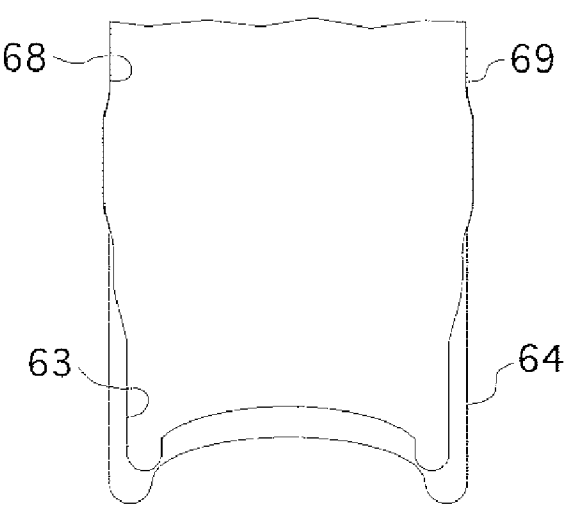
FIG. 6C shows a partial cross-section of a double-walled container according to another embodiment of the invention.
Figure 6B:
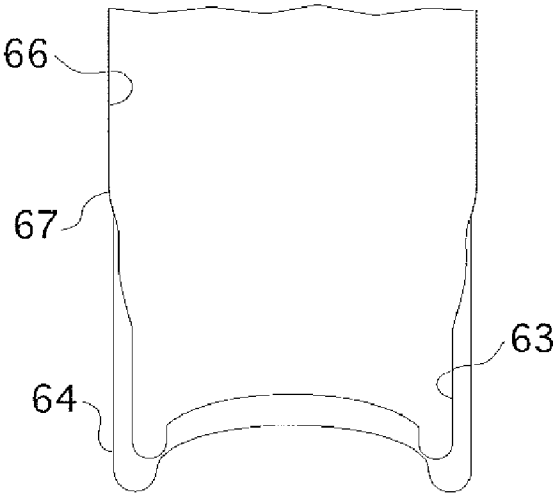
FIG. 6B shows a partial cross-section of a double-walled container according to one embodiment of the invention.
Figure 6A:
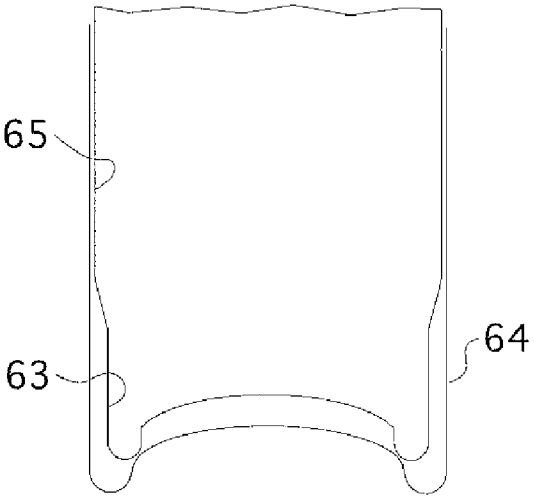
FIG. 6A shows a partial cross-section of a first container inside a second container.

FIGS. 6A-6C show the effects of steps in an interlocking process according to one embodiment of the invention. FIG. 6A shows a first container 63 resting inside a second container 64. A portion 65 of the first container 63 has been expanded so that there is little clearance between the first container and the second container 64. In FIG. 6B, a second portion 66 of the first container 63 has been expanded along with a portion 67 of the second container 64. In FIG. 6C, a second portion 69 of the second container 64 has been narrowed along w/a third portion 68 of the first container 63. Through the expansion and narrowing processes, the first container 63 has been interlocked to the second container 64.

In some embodiments of the invention the first and second containers start out having the same diameters. In some embodiments, the step of providing a second container having a diameter Y comprises providing a second container having a diameter having a diameter Z and expanding the second container to the diameter Y. The diameter Z may equal the diameter X, or Z may be a different diameter than X. In some embodiments the step of providing the first container having a diameter X comprises providing a first container having a diameter W and narrowing the first container to a diameter X. The diameter W may equal to the diameter Y or W may be a different diameter than Y.

In some embodiments, the sidewalls of the first and second containers are straight, i.e. have a substantially uniform diameter at the beginning of the process, as shown, for example, in FIGS. 4A, 4C, 5A and 5C. In some embodiments, the sidewalls of the first and second containers are curved or tapered. For example, the double-walled container shown in FIG. 3 could be manufactured with first and second containers having curved sidewalls.

Referring now to FIG. 1, in some embodiments, the dome 14 of the first container 11 is not of a substantially similar size and/or shape of the dome 15 of the second container 12 so that the dome of the first container does not nest into the dome of the second container. This enhances the thermal insulating properties of the double-walled container 10. The non-nesting dome configuration can be observed in FIGS. 1-3.

As can be seen in FIG. 1, a gap 16 lies between a portion of the first container and a portion of the second container. In some embodiments, the width of the gap 16 is about 0.080" to about 0.085" in some areas. In other embodiments, the width of the gap 16 is about 0.020" to about 0.040" is some areas, about 0.060" to about 0.080" in some areas, or about 0.020" to about 0.125" in some areas. When the width of the gap is 0.080", there is a 0.160" difference in diameter between the first (inner) container and the second (outer) container. As can be observed in the figures, the width of the gap is not uniform in some embodiments. In some embodiments, this gap 16 may be filled partially or completely with air or another insulating material. Any appropriate insulating material may be used.

Figure 7A:
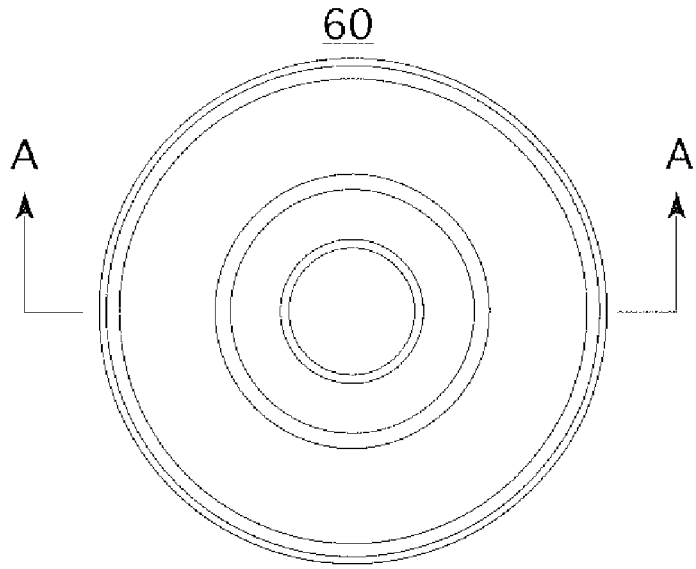
FIG. 7A shows a top view of an expansion die used to manufacture the double-walled container of FIG. 4B.
Figure 7B:
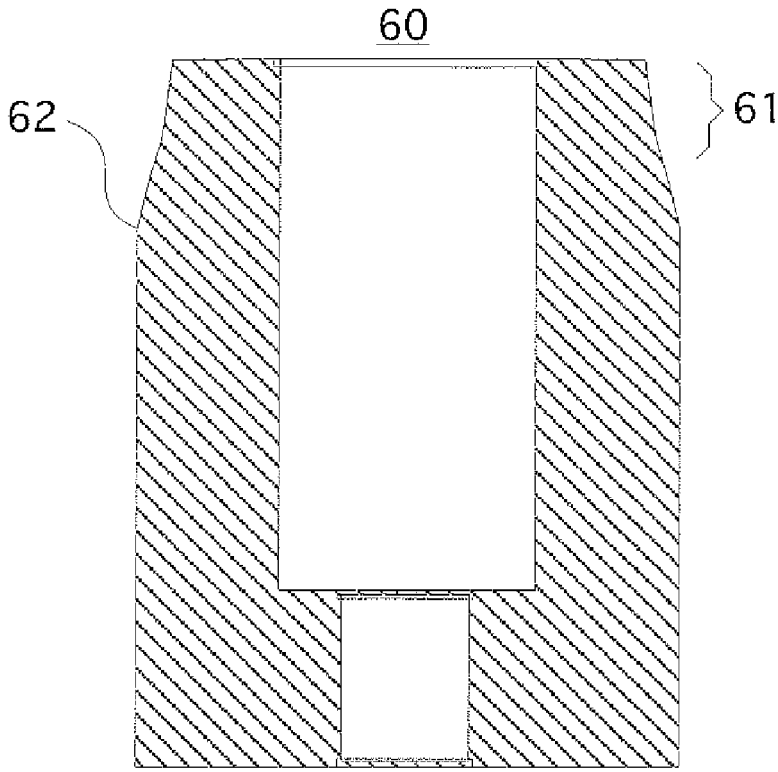
FIG. 7B shows a cross-section along line A-A view of the expansion die of FIG. 7A.
Figure 8A:
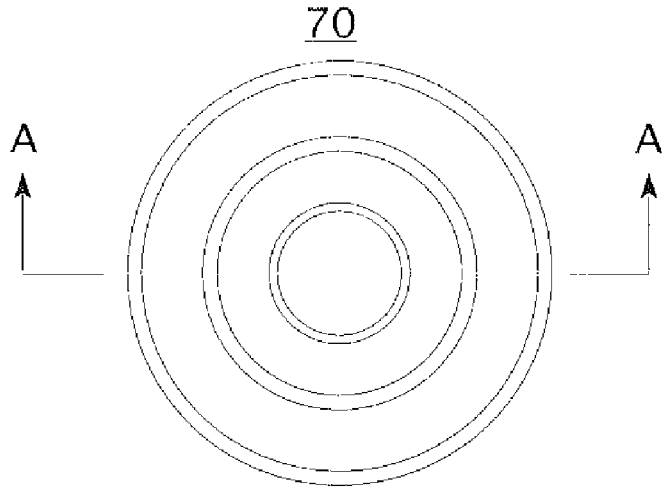
FIG. 8A shows a top view of an expansion die used to manufacture the double-walled container of FIG. 4D.
Figure 8B:
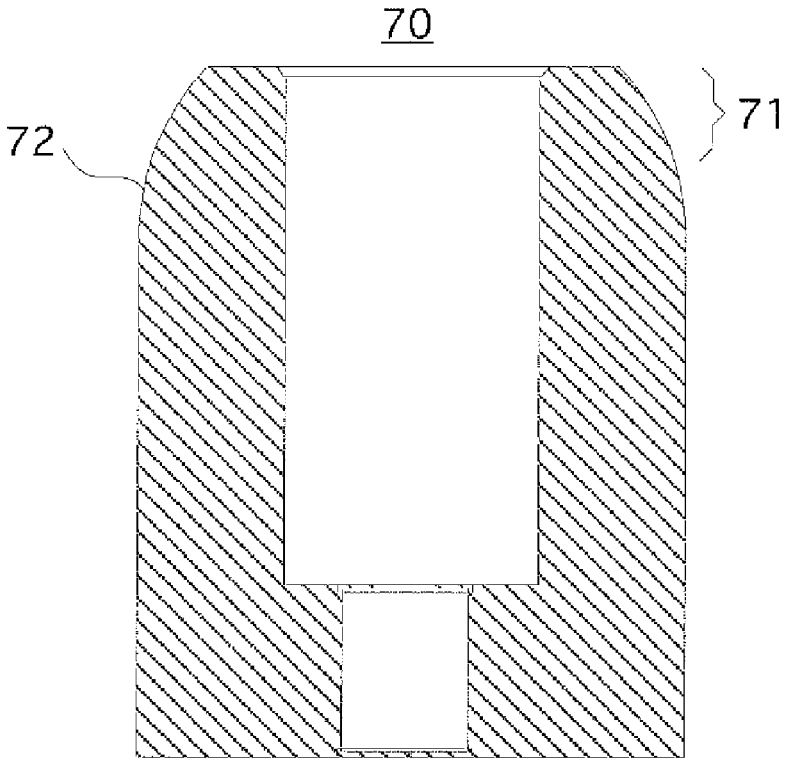
FIG. 8E shows a cross-section along line A-A of the expansion die of FIG. 5A.

In some embodiments, expanding the diameter X of a portion of the first container comprises inserting an expansion die, examples of which are shown in FIGS. 7 and 8, at least partially into the first container. In some embodiments, when the expansion die is inserted into the first container, the diameter Y of a portion of the second container is expanded also. In some embodiments, at least one expansion die is inserted into an open end of the first container to expand the diameter of the double-walled container. Another expansion die can be inserted into the open end of the container to further expand the diameter of the container. This process can be repeated until the desired shape of the double-walled container is achieved. Examples of possible stages of expansion of the double-walled container can be seen in FIGS. 4 and 5.

The number of expansion dies used to expand the double-walled container to a desired diameter without significantly damaging the container is dependent on the degree of expansion desired, the material of the container, the hardness of the material of the container, and the sidewall thickness of the container. For example, the higher the degree of expansion desired, the larger the number of expansion dies required. Similarly, if the metal comprising the container has a hard temper, a larger number of expansion dies will be required as compared to expanding a container comprised of a softer metal the same degree. Also, the thinner the sidewall, the greater number of expansion dies will be required. Further, when expanding a coated container, a gradual expansion will help to maintain the integrity of the coating. Alternatively, a container may be expanded before coating.

Referring again to expansion dies 60 and 70 of FIGS. 7 and 8, respectively, in some embodiments, the die 60 or 70 is comprised of A2 tool steel, 58-60 Rc harden, 32 finish, although any suitable die material may be used. Initial portions 61 and 71 of the work surfaces 62 and 72 in the FIGS. 7 and 8, respectively, have a geometry for gradually transitioning the diameter of the container sidewall. The work surfaces 62 and 72 of dies 60 and 70 have dimensions and geometries that when inserted into the open end of a container work the container's sidewall to radially expand the container's diameter in a progressive manner as the container travels along the work surface. In some embodiments, the expansion die includes a work surface, having a progressively expanding portion, a land portion, and a tapered portion transitioning to an undercut portion. In some embodiments, the land portion has dimensions and a geometry for setting the final diameter of the container being formed by that expansion die. In some embodiments, the tapered portion transitions from the land portion to the undercut portion. In some embodiments, the diameter of the undercut portion is less than the diameter of the land portion. In some embodiments, the undercut portion extends at least the length of the portion of the container being expanded minus the length of the land portion and the initial portion of the die. The undercut portion allows for springback and reduces the total contact area between the can and the die minimizing total forming loads. In some embodiments, when only a small top portion of a container is being expanded, an expansion die not having a land or undercut portion is used. For example, a container having the profile shown in FIG. 1 was expanded using a die not having a land portion or an undercut portion.

Figure 9A:
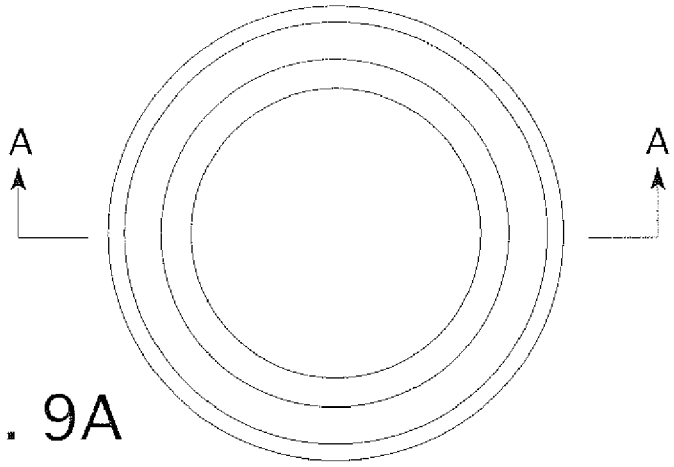
FIG. 9A illustrates a top view of a double-walled container according to yet another embodiment of the invention.
Figure 9B:
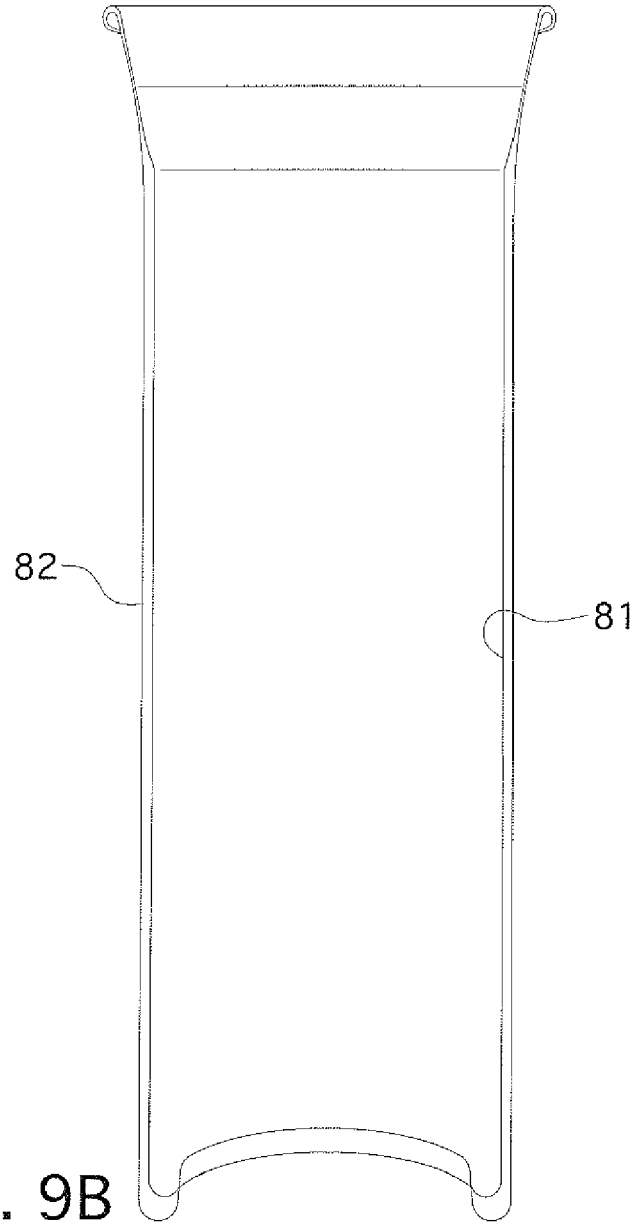
FIG. 9B illustrates a cross-section along line A-A of the double-walled container of FIG. 9A.
Figure 9C:
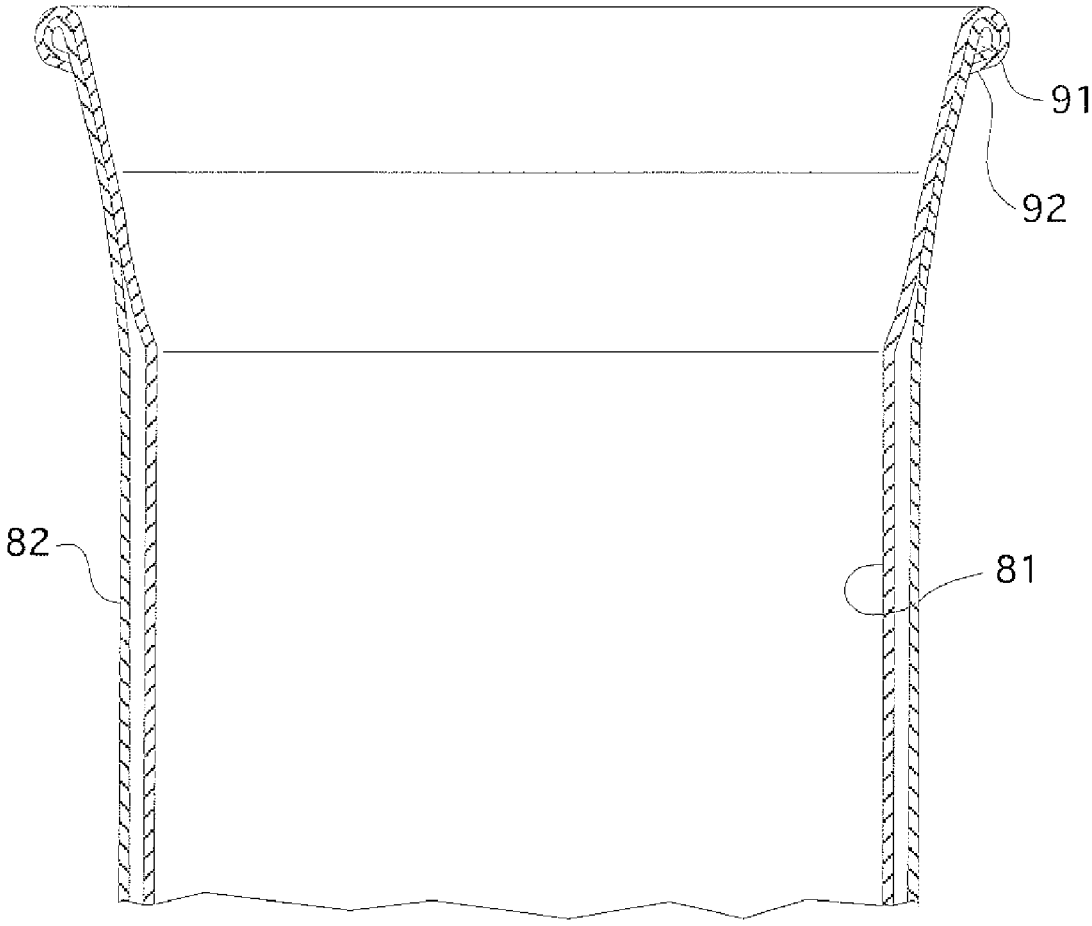
FIG. 9C illustrates a partial cross-section along line A-A of the double-walled container of FIG. of 9A.
Figure 10A:
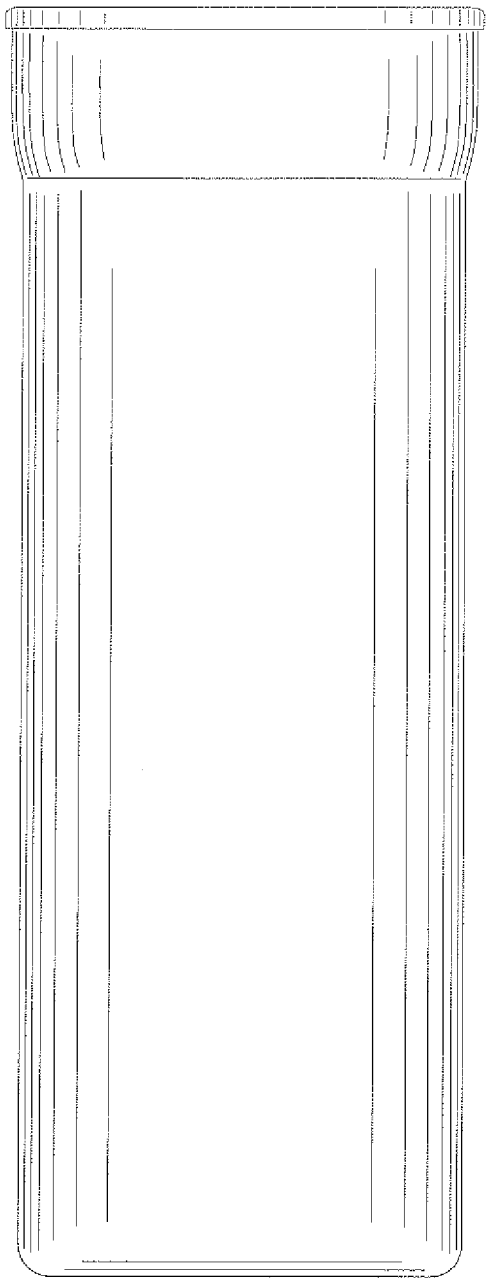
FIG. 10A shows a side view of a double-walled container according to a further embodiment of the invention.
Figure 10B:
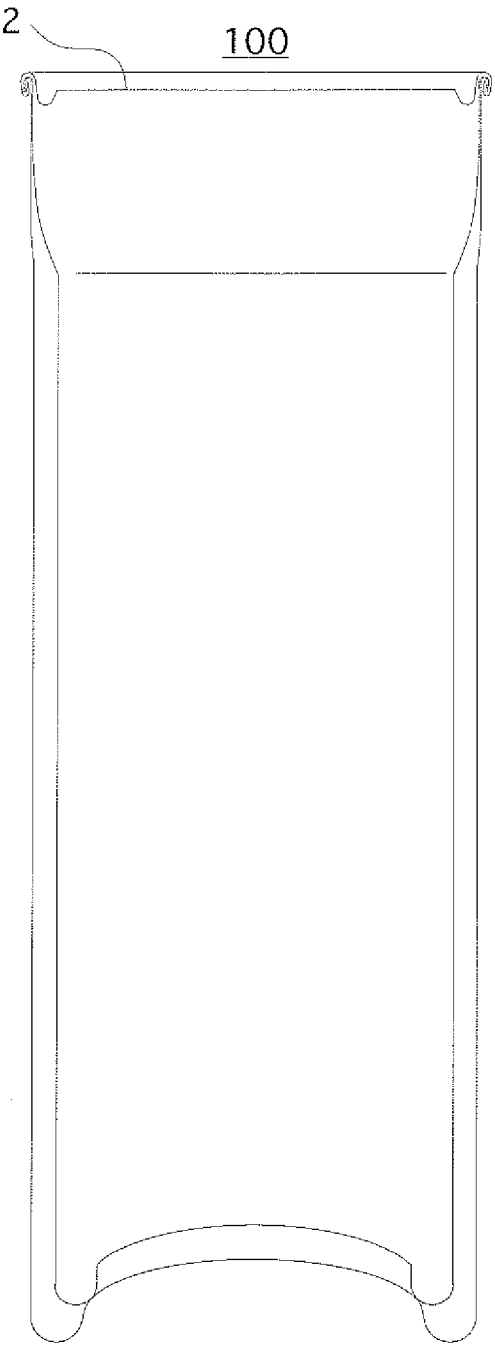
FIG. 10B depicts a cross-section along line A-A of the double-walled container of FIG. 10A.
Figure 10D:
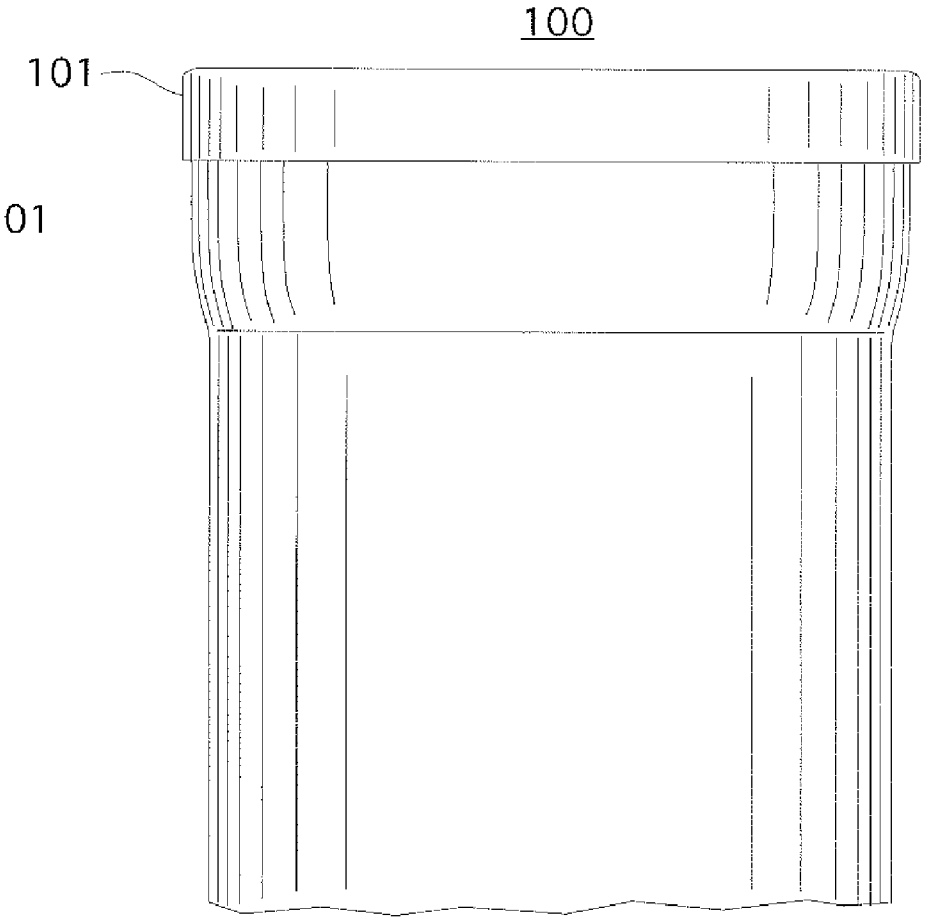
FIG. 10D illustrates a partial side view of the double-walled container of FIG. 10A.
Figure 10C:
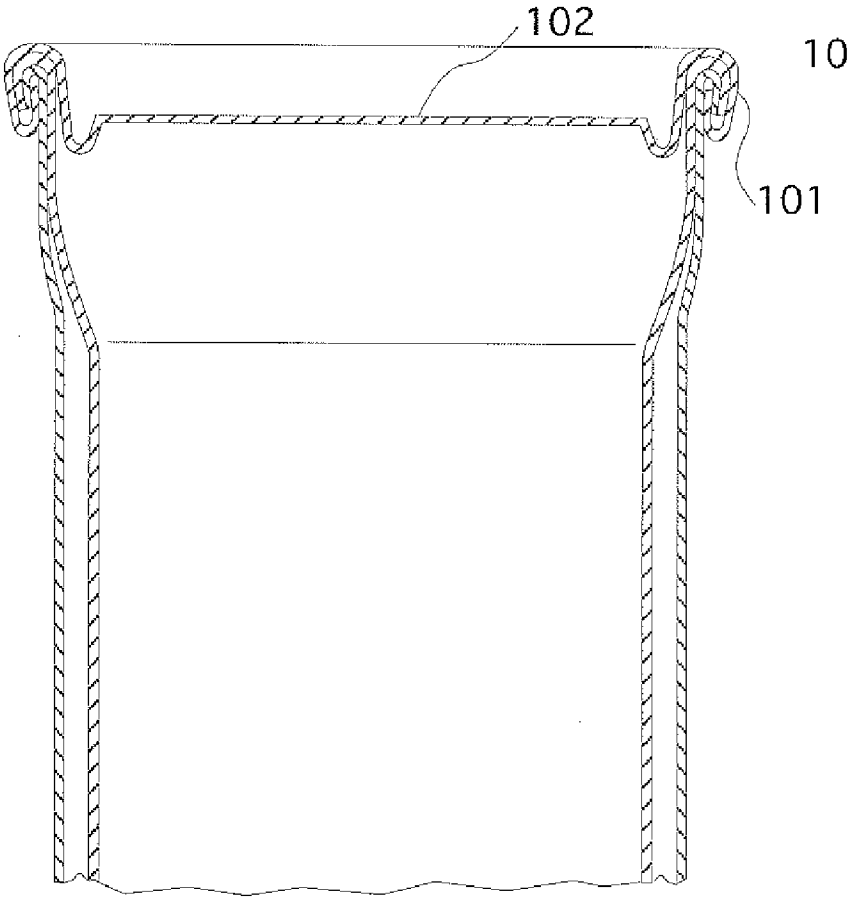
FIG. 10C shows a partial cross-section along line A-A of the double-walled container of FIG. 10A.
Figure 11A:
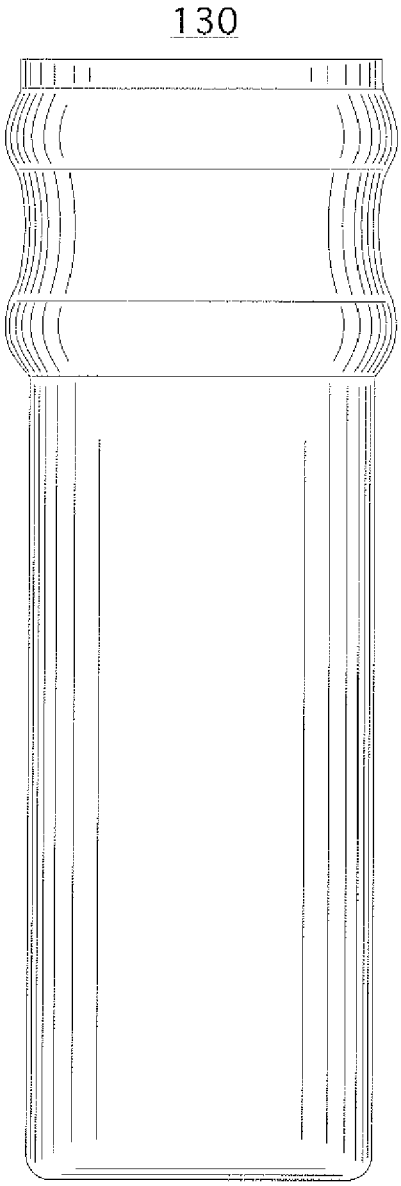
FIG. 11A shows a side view of a double-walled container according to yet a further embodiment of the invention.
Figure 11B:
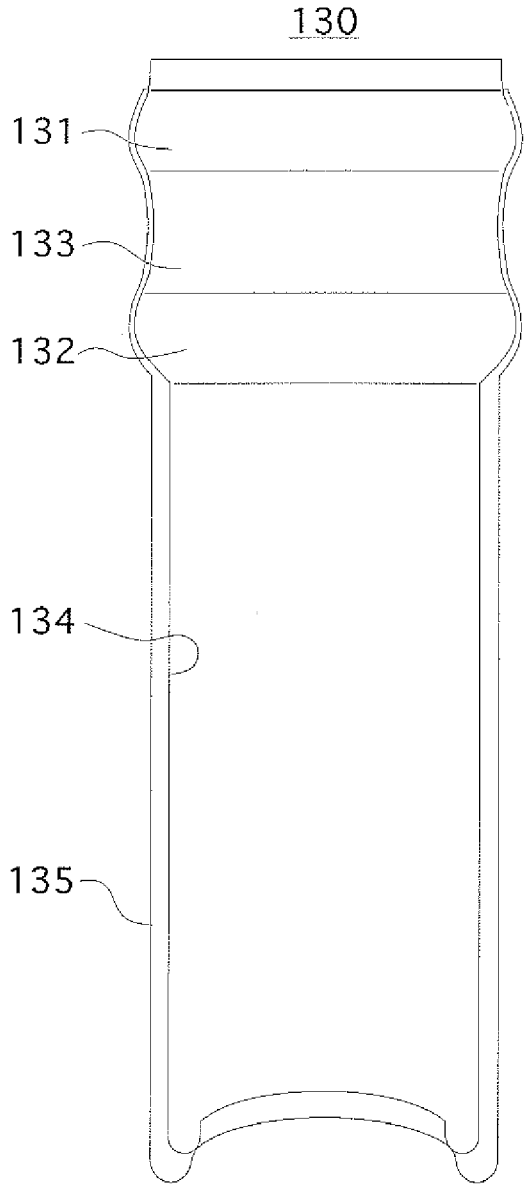
FIG. 11B depicts a cross-section along line A-A of the double-walled container of FIG. 11A.
Figure 11D:
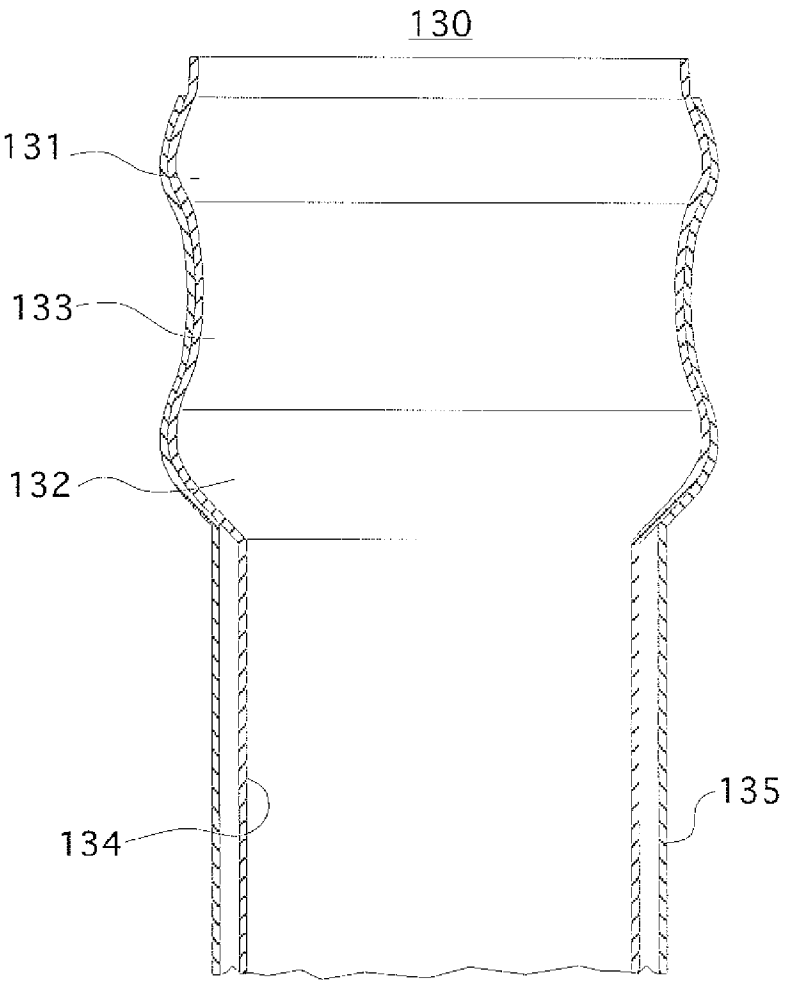
FIG. 11D illustrates a partial cross-section along line A-A of the double-walled container of FIG. 11A.
Figure 11C:
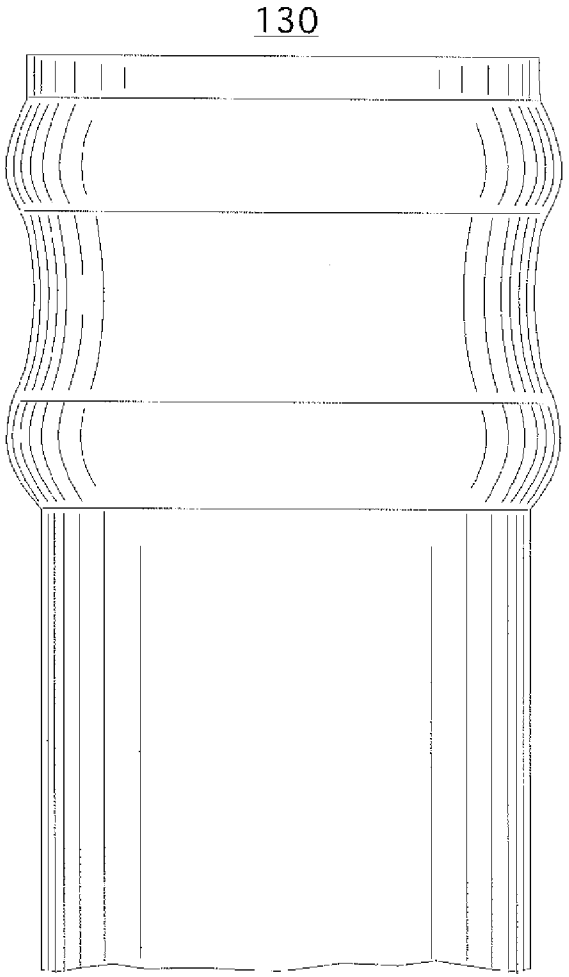
FIG. 11C shows a partial side view of the double-walled container of FIG. 11A.

In some embodiments, a top edge of the first container is curled. In some embodiments, the curling may be done after first inserting an expansion die at least partially into the first container and expanding a top portion of the first container, and possibly the top portion of the second container also. In some embodiments the top edge of the second container is curled also. In some embodiments, when the curl is toward the inside of the double-walled container, the top edge of the second container is curled over top of, or along with, the top edge of the first container. In some embodiments, when the curl is toward the outside of the double-walled container, the top edge of the first container is curled over top of, or along with, the top edge of the second container. An example of a curl on the double-walled container can be seen in FIGS. 9A-9C. In FIG. 9C, top edges 91 and 92 of both the first container 81 and the second container 82 are curled outward.

In some embodiments, the top edges of the first container and the second container are flanged and seamed along with a closure or just the top edge of the first container is flanged and seamed along with a closure. Any appropriate flanging and seaming method may be used. An example of a double-walled container 100 having a flanged and seamed top edge 101 and closure 102 can be seen in FIG. 10.

In some embodiments, wherein a portion of the first and/or second containers is narrowed the narrowing can be accomplished via die necking, spin necking or any suitable method. The diameter of the narrowed portion of the double-walled container may be less than, equal to, or greater than diameter X. In some embodiments, the distance from the top edge of the double-walled container where it is narrowed is less than the distance from the top edge of the container where it is expanded. In some embodiments, the double-walled container is necked in several steps with several different necking dies. In other embodiments, the double-walled container is necked with only one necking die. Any appropriate necking die(s) known in the art may be used. In some embodiments the double-walled container may be necked so that it takes the shape of a bottle or a beverage can. In some embodiments, after the double-walled container is narrowed, a portion of the container is expanded until a desired shape is attained. The double-walled container can be repeatedly necked and expanded until a desired shape is achieved. A double-walled container wherein the top portions of the first and second containers were interlocked by narrowing top portions of the first and second containers is shown in FIG. 11. The double-walled container 130 in FIG. 11 was narrowed using a necking die. The double-walled container 130 has two expanded portions 131 and 132 separated by a necked in portion 133.

In some embodiments the first container has a different height than the second container. In FIG. 11, the first container 134 is taller than the second container 135.

Figure 12A:
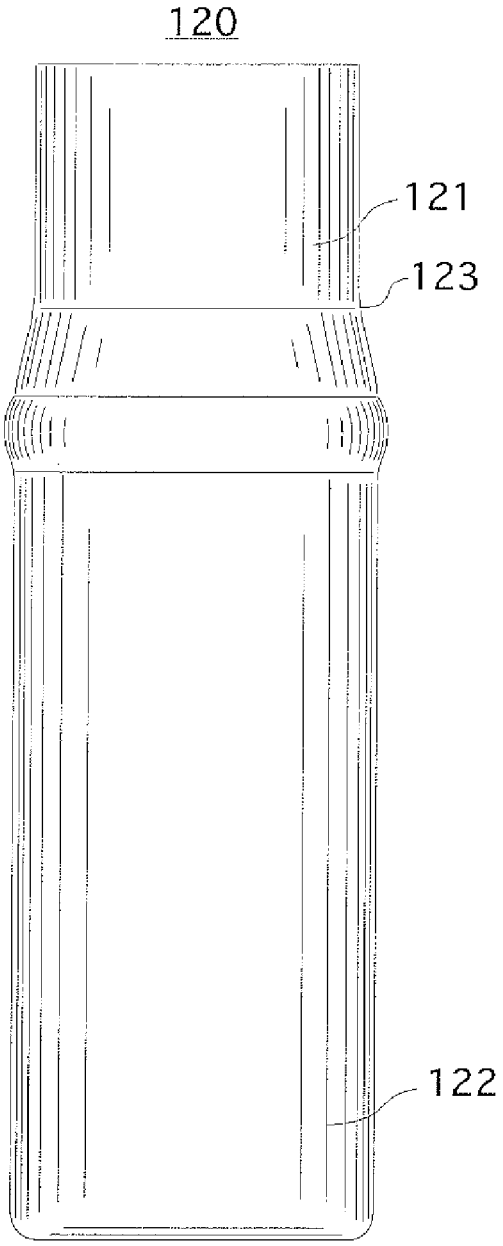
FIG. 12A depicts a double-walled container according to another embodiment of the invention.
Figure 12B:
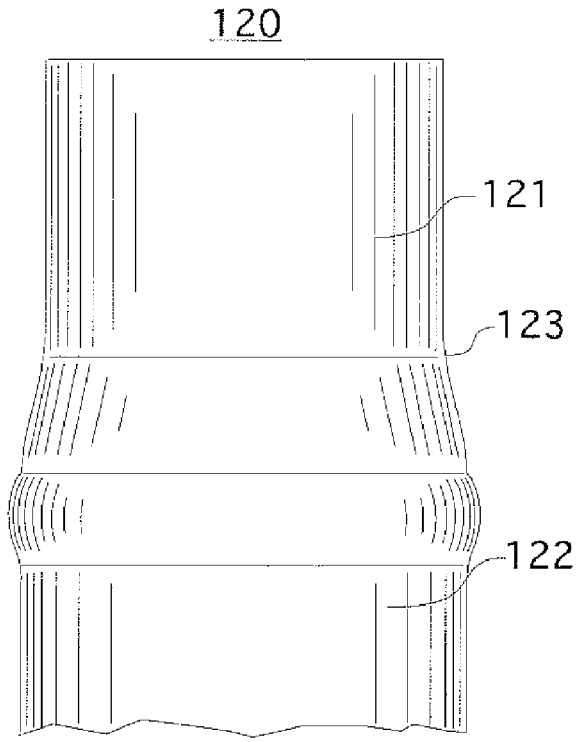
FIG. 12B shows a partial close up view of the double-walled container of FIG. 12A.

FIGS. 12A and 12B show another example of a double-walled container 120 wherein the first container 121 is taller than the second container 122. After the first container 121 was placed inside of the second container 122, both the first container and the second container were expanded then narrowed to interlock the first container and the second container. The top edge 123 of the second container 122 lies on the narrowed portion of the containers. The double-walled container 120 of FIG. 12 can be further processed to accept a closure or the top edge of the first container may be curled, for example.

Figure 13:
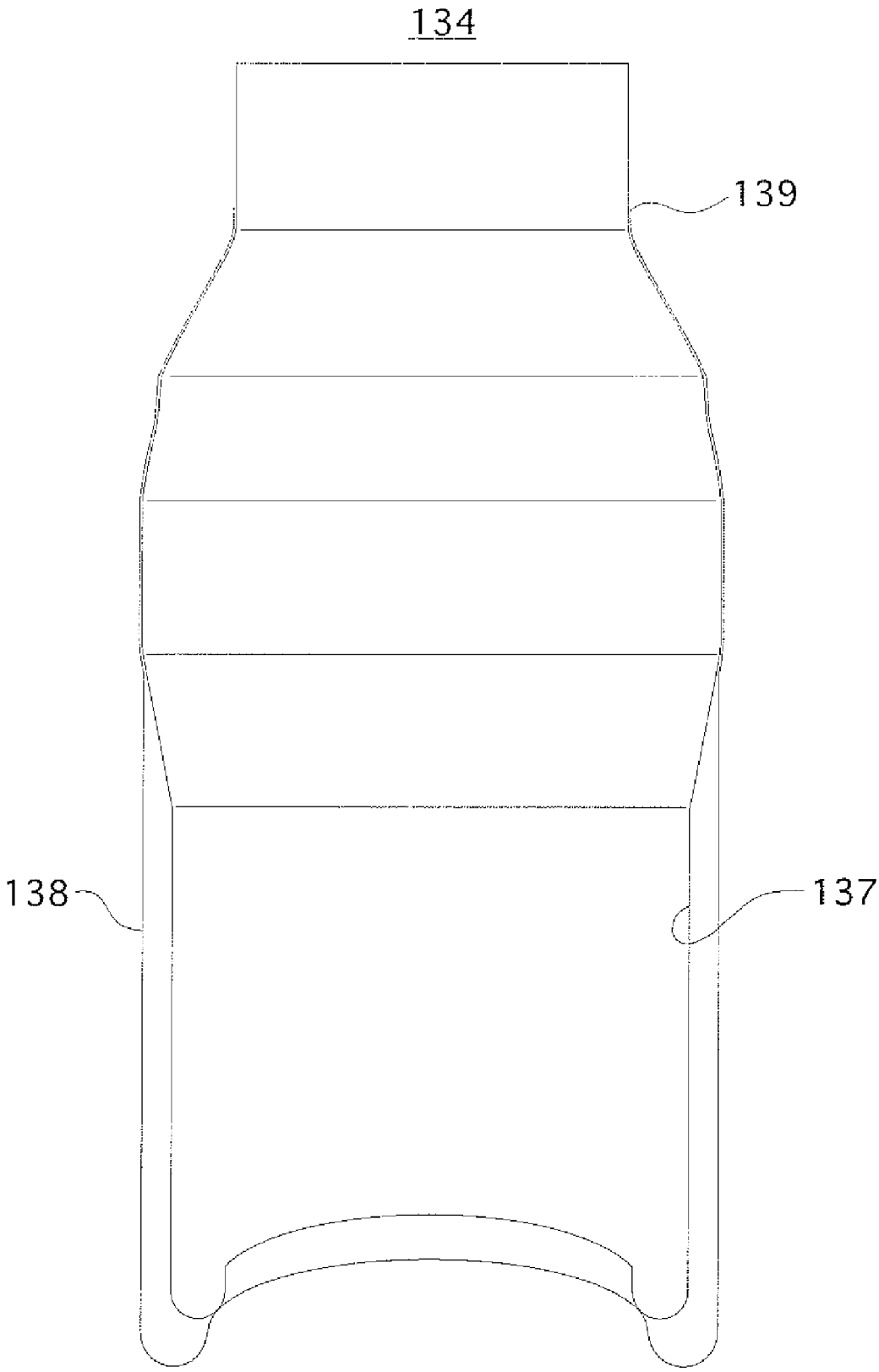
FIG. 13 illustrates a partial cross-section view of a double-walled container according to yet a further embodiment of the invention.

FIG. 13 shows yet another example of a double-walled container 136 wherein the first container 137 is taller than the second container 138. After the first container 137 was placed inside of the second container 138, both the first container and the second container were expanded then narrowed to interlock the first container and the second container. The top edge 139 of the second container can be seen in FIG. 13. The double-walled container 136 of FIG. 13 can be further processed to accept a closure or the top edge of the first container may be curled, for example.

Necking an expanded double-walled container formed in accordance with some embodiments of the invention to a diameter greater than or equal to the first container's original diameter X does not require the use of a knockout because the first container's sidewall is in a state of tension following expansion. In some embodiments, a knockout can be used when necking the container.

In some embodiments, following the final expansion or necking step, the open end of the double-walled container is formed to accept a closure. Any appropriate method of forming to accept a closure may be used including forming a flange, curl, thread, lug, attach an outsert and hem, or combinations thereof. Any appropriate method of threading or forming a lug may be used. Any suitable closure may be used, including but not limited to, standard double-seamed end, full-panel easy-open food end, crown closure, plastic threaded closure, roll-on pilfer proof closure, lug cap, aerosol valve, or crimp closure.

Figure 14:
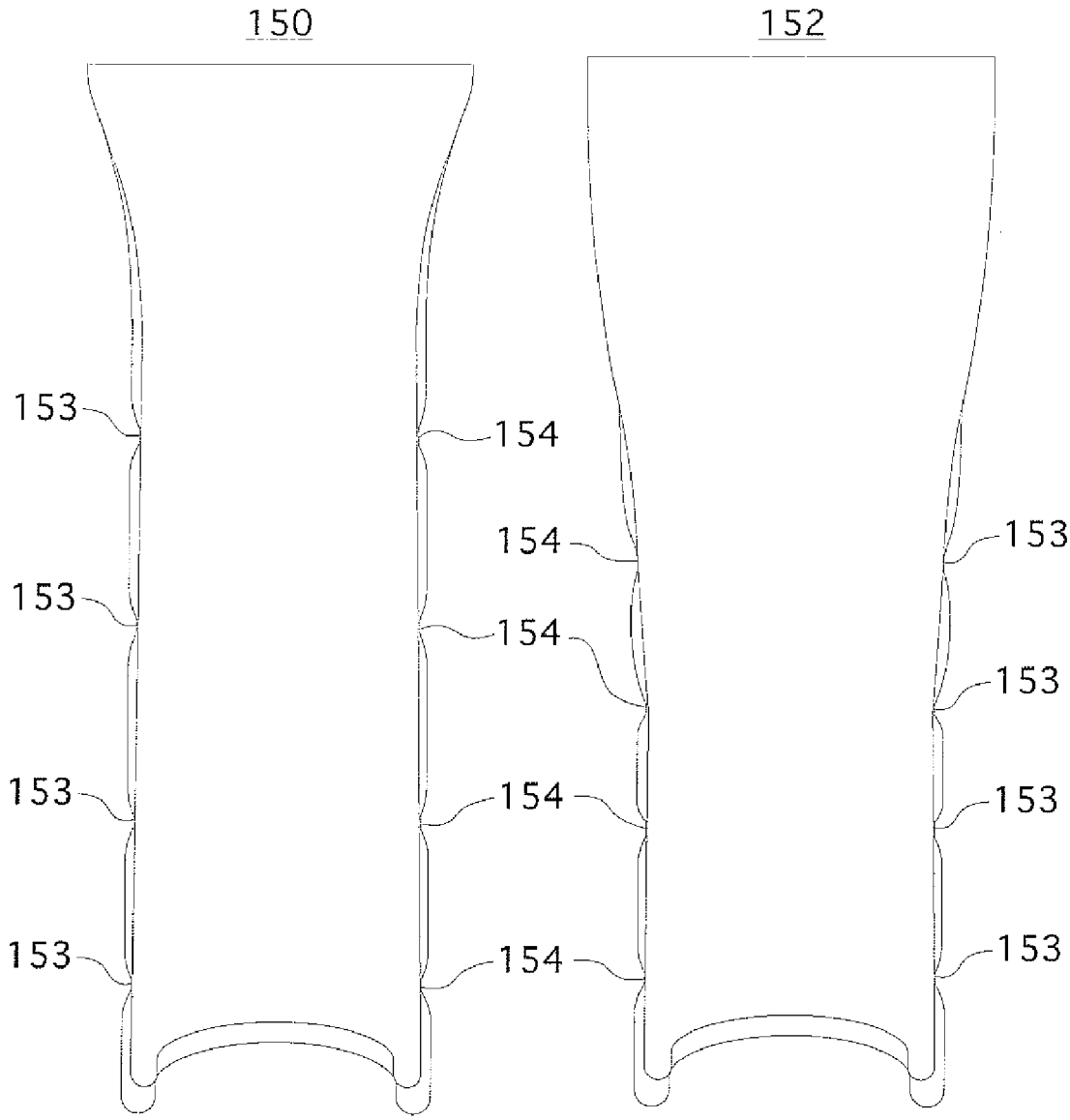
FIG. 14 depicts two examples of double-walled containers according to embodiments of the invention wherein the outside wall of each of the double-walled containers is ribbed.
Figure 15:
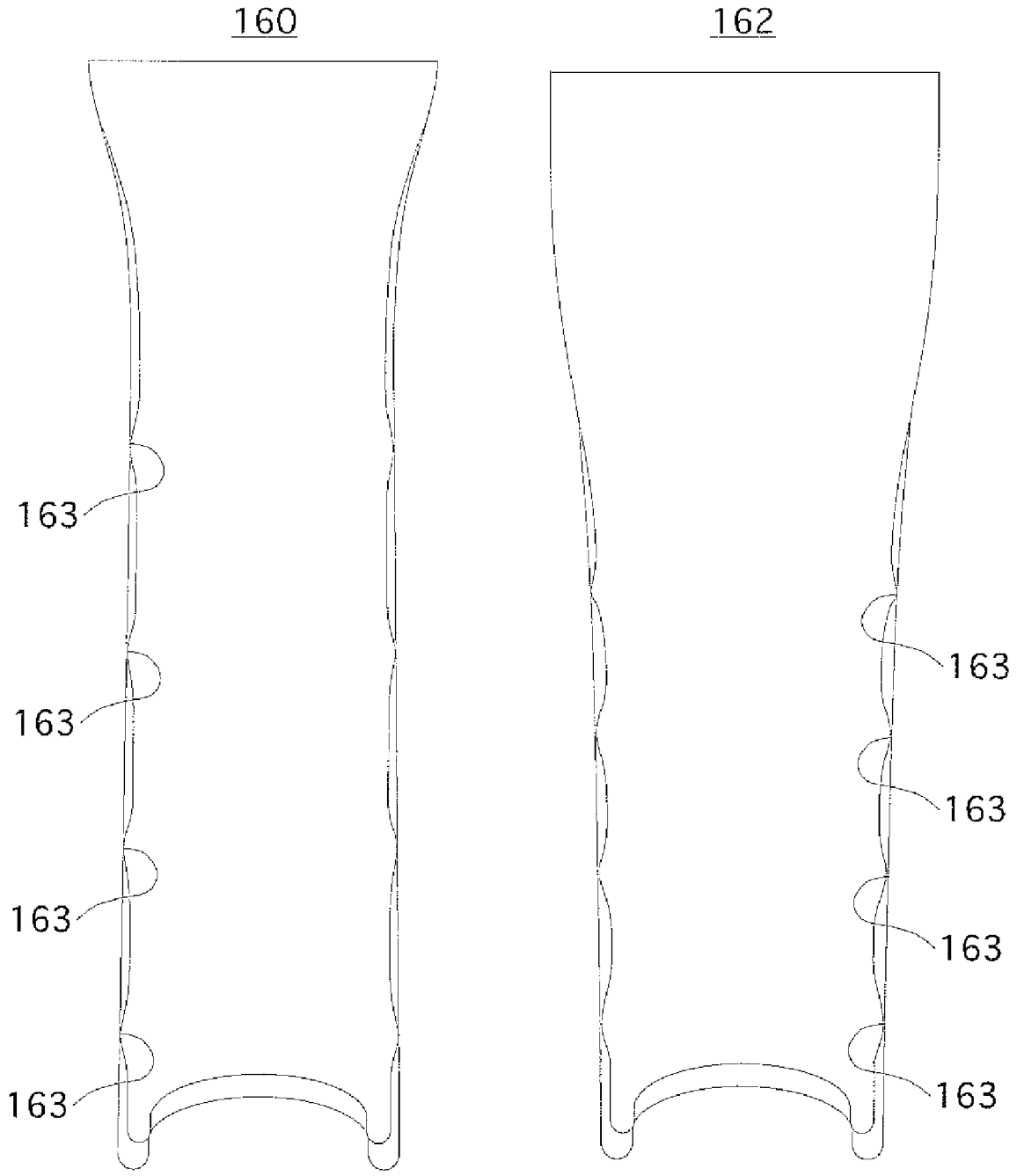
FIG. 15 depicts two examples of double-walled containers according to embodiments of the invention wherein the inside wall of each of the double-walled containers is ribbed.

In some embodiments, the first container, the second container or both containers are ribbed, as shown in FIGS. 14 and 15. FIG. 14 shows two exampled of double-walled containers 150 and 152 wherein the second or outside container has ribs 153. FIG. 15 shows two examples of double-walled containers 160 and 162 wherein the inside container has ribs 163. The containers may be ribbed to establish points of contact 154 between the first container and the second container for rigidity and/or thermal transfer. In one embodiment, when using a thin, hard metal in the inner container, for example, a H19 or H39 temper, and a sidewall metal thickness of about 0.0038" to about 0.015", ribs on the inner container help to maintain the shape of the inner container.

Figure 17:
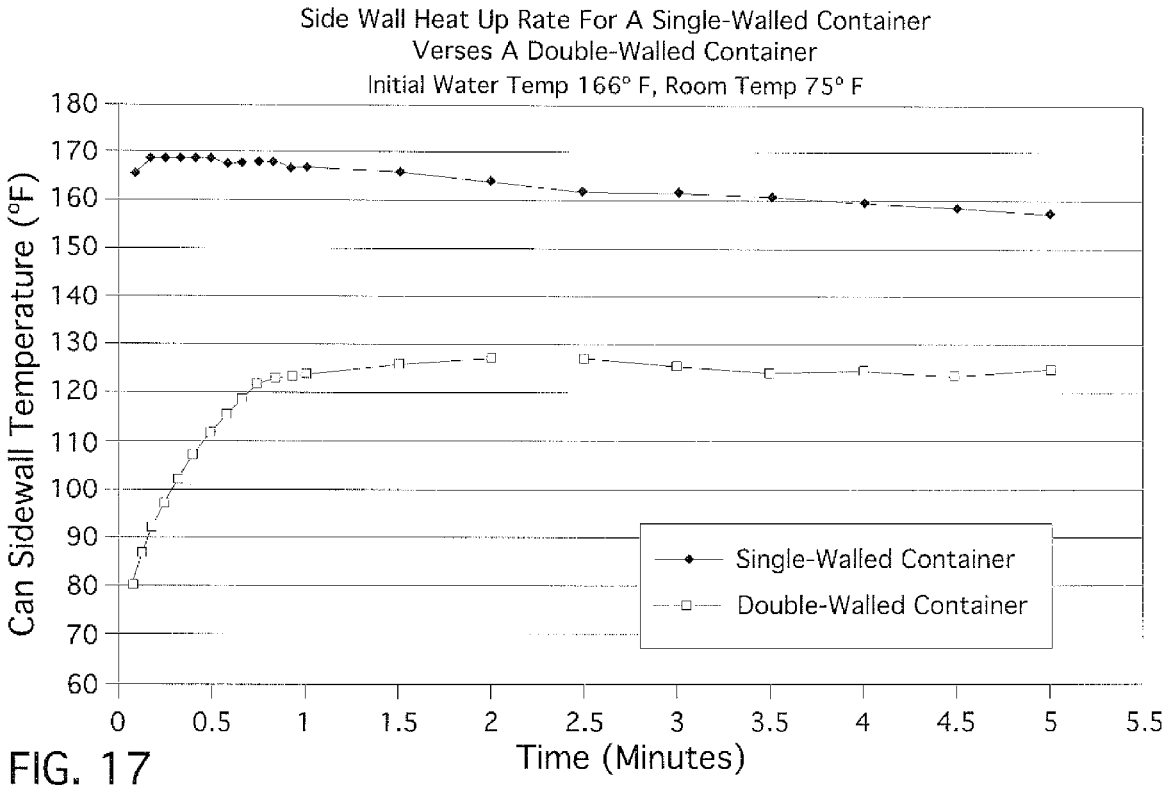
FIG. 17 is a graph showing the heat up rate of the side-wall of a double-walled container vs. the side-wall of a single-walled container.

FIG. 17 shows the heat-up rate of a container outer sidewall starting from room temperature of a single walled container versus a double-walled container containing a fluid having a starting temperature of 166° F. Container F shown in FIG. 4 was the double-walled container used to measure thermal/insulating properties.

Figure 18:
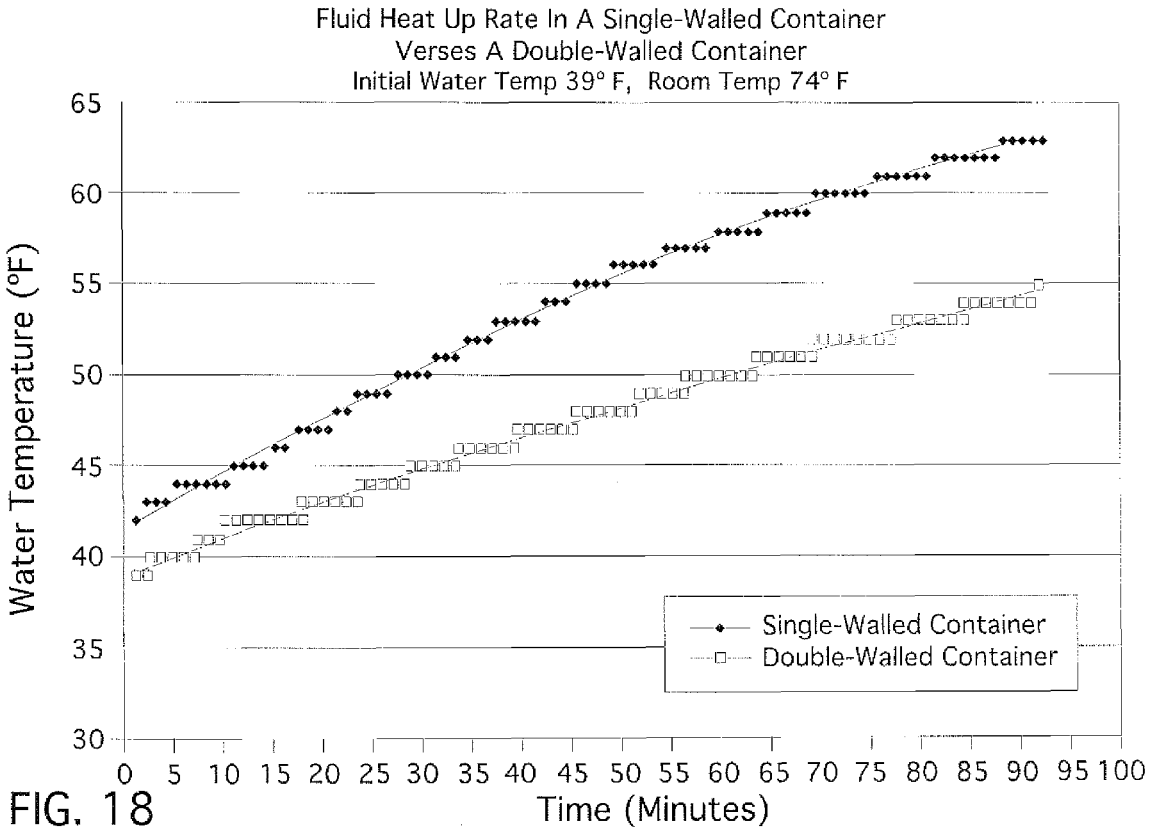
FIG. 18 is a graph showing the heat tip rate of water in a double-walled container vs. water in a single-walled container.

FIG. 18 shows the warming rate of a fluid having an initial temperature of 39° F. inside a single walled container versus a double-walled container at room temperature. After 45 minutes the fluid inside the single walled container warmed to 55° F. The fluid inside the double-walled container took 90 minutes to warm to 55° F. Container F shown in FIG. 4 was the double-walled container used to measure thermal/insulating properties.

Embodiments of the invention may be used in conjunction with any container capable of being expanded and/or narrowed including but not limited to beverage, aerosol, and food containers. The first and second containers provided may be manufactured via any suitable means, including, but not limited to, drawing, draw reverse draw, drawing and ironing, drawing and stretching, deep drawing, 3-piece seamed and impact extrusion. In some embodiments, the container is comprised of aluminum or steel. In some embodiments, the aluminum comprises an alloy, such as Aluminium Association 3104, 3004, 5042, 1060, 1070, steel alloys may also be used. In some embodiments, the alloy has a hard temper, such as H19 or H39. In other embodiments, a softer temper metal is used.

A double-walled container manufactured in accordance with embodiments of the invention can take many shapes, such as pilsner or other drinking container, a beverage can, or a bottle.

Although the present invention has been described in considerable detail with reference to certain versions thereof, other versions are possible. All features disclosed in the specification, including the drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means or step for" clause as specified in 35 U.S.C. §112.

What is claimed is:

1. A method of manufacturing a metal double-walled container comprising:

providing a first metal container having a diameter X;

providing a second metal container having a diameter Y, wherein the diameter Y is larger than the diameter X;

inserting the first metal container into the second metal container; and interlocking the first metal container and the second metal container so that a gap lies between a first portion of the first metal container and a first portion of the second metal container, wherein interlocking comprises:

inserting an expansion die into an open end of the first metal container so that the diameter X of a second portion of the first metal container expands; and narrowing the diameter Y of a second portion of the second metal container so that the first metal container and the second metal container become interlocked; and narrowing an opening of the metal double-walled container to accept a closure.

2. The method of claim 1 wherein the diameter Y of a third portion of the second metal container expands as the diameter X of the second portion of the first metal container is expanded.

3. The method of claim 1 wherein the first metal container and/or the second metal container have ribs.

4. A method of claim 1 wherein inserting the expansion die occurs prior to narrowing the diameter Y of the second portion of the second metal container.

5. The method of claim 1 wherein narrowing the diameter Y of the second portion of the second metal container occurs prior to inserting the expansion die.

6. A method of manufacturing a metal double-walled container comprising:

providing a first metal container having a diameter X and a height H;

providing a second metal container having a diameter Y and a height J, wherein the diameter Y is larger than the diameter X and the height H is taller than the height J;

inserting the first metal container into the second metal container; and interlocking the first metal container and the second metal container so that a gap lies between a first portion of the first metal container and a first portion of the second metal container;

wherein interlocking the first metal container and the second metal container comprises narrowing a top portion of the first metal container and a top portion of the second metal container; and expanding the diameter X of a second portion of the first metal container and the diameter Y of a second portion of the second metal container prior to narrowing.

7. The method of claim 6 wherein the first metal container and/or the second metal container have ribs.

8. A method of manufacturing a metal double-walled container comprising:

providing a first metal container having a diameter X;

providing a second metal container having a diameter Y, wherein the diameter Y is larger than the diameter X;

inserting the first metal container into the second metal container; and interlocking the first metal container and the second metal container so that a gap lies between a first portion of the first metal container and a first portion of the second metal container, wherein interlocking comprises:

inserting an expansion die into an open end of the first metal container so that the diameter X of a second portion of the first metal container expands; and finishing a top edge of the first metal container so that the first metal container and the second metal container become interlocked wherein finishing comprises seaming and wherein a top edge of the second metal container is double-seamed as the top edge of the first metal container is double-seamed.

9. The method of claim 8 wherein the diameter Y of a third portion of the second metal container expands as the diameter X of the second portion of the first metal container is expanded.

10. The method of claim 8 wherein the first metal container and/or the second metal container have ribs.

11. A method of manufacturing a metal double-walled container comprising:

providing a first metal container having a diameter X;

providing a second metal container having a diameter Y, wherein the diameter Y is larger than the diameter X;

inserting the first metal container into the second metal container; and interlocking the first metal container and the second metal container so that a gap lies between a first portion of the first metal container and a first portion of the second metal container, wherein interlocking comprises:

inserting an expansion die into an open end of the first metal container so that the diameter X of a second portion of the first metal container expands; and finishing a top edge of the first metal container so that the first metal container and the second metal container become interlocked wherein finishing comprises curling and wherein a top edge of the second metal container is curled as the top edge of the first metal container is curled.

12. The method of claim 11 wherein the diameter Y of a third portion of the second metal container expands as the diameter X of the second portion of the first metal container is expanded.

13. The method of claim 11 wherein the first metal container and/or the second metal container have ribs.

14. A method of manufacturing a metal double-walled container comprising:

providing a first metal container having a diameter X;

providing a second metal container having a diameter Y, wherein the diameter Y is larger than the diameter X;

inserting the first metal container into the second metal container; and interlocking the first metal container and the second metal container so that a gap lies between a first portion of the first metal container and a first portion of the second metal container, wherein interlocking comprises:

inserting an expansion die into an open end of the first metal container so that the diameter X of a second portion of the first metal container expands; and narrowing the diameter Y of a second portion of the second metal container so that the first metal container and the second metal container become interlocked;

wherein inserting the expansion die occurs after inserting the first metal container into the second metal container and prior to narrowing the diameter Y of the second portion of the second metal container.

15. A method of manufacturing a metal double-walled container comprising:

providing a first metal container having a diameter X;

providing a second metal container having a diameter Y, wherein the diameter Y is larger than the diameter X;

inserting the first metal container into the second metal container; and interlocking the first metal container and the second metal container so that a gap lies between a first portion of the first metal container and a first portion of the second metal container, wherein interlocking comprises:

inserting an expansion die into an open end of the first metal container so that the diameter X of a second portion of the first metal container expands; and narrowing the diameter Y of a second portion of the second metal container so that the first metal container and the second metal container become interlocked;

wherein narrowing the diameter Y of the second portion of the second metal container occurs after inserting the first metal container into the second metal container and prior to inserting the expansion die.

* * * * *